United States Patent [19]

Cygnor et al.

[11] 4,417,851

[45] Nov. 29, 1983

[54] MODULATED DIFFUSER PUMP

[75] Inventors: John E. Cygnor; Terry L. Whitesel, both of Rockford; Duane C. Mosure, Poplar Grove, all of Ill.

[73] Assignee: Sundstrand Corporation, Rockford, Ill.

[21] Appl. No.: 207,302

[22] Filed: Nov. 17, 1980

[51] Int. Cl.[3] ..... F04D 29/46

[52] U.S. Cl. ..... 415/150; 415/211

[58] Field of Search ..... 415/25, 36, 148, 150, 415/209, 210, 211; 251/248, 250.5, 309, 313, 337

[56] References Cited

U.S. PATENT DOCUMENTS

| | | | |
|---|---|---|---|
| 1,929,694 | 10/1933 | Judson, Jr. | 251/313 X |
| 2,917,273 | 12/1959 | Best | 251/248 |
| 3,276,737 | 10/1966 | Koutnik | 251/250.5 |
| 3,841,789 | 10/1974 | Corrigan et al. | 415/148 |
| 4,219,305 | 8/1980 | Mount et al. | 415/148 X |

*Primary Examiner*—Philip R. Coe
*Assistant Examiner*—Joseph M. Pitko
*Attorney, Agent, or Firm*—Harold A. Williamson; Ted E. Killingsworth; Michael B. McMurry

[57] ABSTRACT

This invention relates to a fully modulatable centrifugal pump capable of handling a fluid containing solid contaminant particles and minimizing the temperature rise of the pumped fluid. The pump is of the type that includes an impeller to propel the fluid through a radial outlet to a diffuser which includes a plurality of diffuser passages. The improvement is comprised of the following cooperative combination which includes rotatably mounted valve elements passing, in part, through the diffuser and across the diffuser passages. Each of the valve elements have a port therethrough to variably selectively allow fluid passage therethrough upon rotation of the valve element. A driving arrangement is coupled to each of the valve elements to thereby affect a yieldable rotation of the valve elements in one direction to progressively reduce the opening of the valve element port to the diffuser passage. The aforementioned driving arrangement is also drivingly coupled to the valve elements to provide a direct mechanical coupling to the valve element to thereby affect a nonyieldable rotation of the valve element in an opposite direction to increase the opening of the valve port to the diffuser passage, to thereby ensure that contaminant particles that lodge between a portion of said valve port and the diffuser passage and interrupt movement of one or more valve element port closings do not prevent the remaining valve port elements from closing. During the opposite rotation of the valve elements there is a direct mechanical drive that ensures the opening of the valve port to thereby release the contaminant particle and allow passage of the particle from the valve element and the diffuser.

11 Claims, 8 Drawing Figures

MODULATED DIFFUSER PUMP

TECHNICAL FIELD

This invention relates to a centrifugal pump having single or multiple modulated diffuser outputs and capable of handling a fluid containing solid contaminant particles.

BACKGROUND ART

Todays high performance aircraft more than at any time in history are placing exacting demands on the fuel pumps that provide a controlled supply of fuel to be burned in the engines. In the prior art one finds typically, engine driven gear pumps sized for maximum output at sea level. These pumps are hydraulically connected in combination with fuel pump by-pass valves and lines as well as a metering valve controlled by a hydromechanical computer. The computer is responsive to such inputs from the engine as speed as well as various pressures and temperatures. A pilot's power control lever is coupled to the computer and pilot controlled position of the control lever dictates the power sought from the engines. The metering valve is controlled by the hydromechanical computer to provide a variable area for fuel to pass on its way to be burned in the engine or engines.

The aircraft of the future that are in the process of being manufactured and are on the drawing boards today, have available a most powerful tool in the form of the microprocessor technology. A microprocessor loaded computer can and will handle more efficiently all the functions of the prior art by-pass valves, lines, hydromechanical computer and metering valve, all in such a manner that a single control signal will be provided that will establish by closed loop control on the engine process the fuel flow required for a specific level of power commanded by the pilot. Ideally this single signal would be coupled to a servo which servo would in turn directly control an infinitely variable fuel pump. The centrifugal pump to be described in detail hereinafter meets the needs of the future by providing a pump with a modulatable output that can be varied infinitely, that can withstand the ever present hostile problem created by the presence of unfiltered contaminant particles inherently present in fuel and fuel delivering systems and will minimize the temperature rise of the fuel flowing through it and thereby maximizing the fuel heat sink available for cooling the air frame and engine systems.

Variable diffuser centrifugal pumps for minimizing pump fluid temperature rise by reducing recirculation losses are not new as is evidenced by U.S. Pat. No. 3,784,318 to Donald Y. Davis. The Davis pump is provided with a discharge shutter valve which provides a variable diffuser for the pump. The shutter valve 52, best seen in FIG. 4, includes a hollow slotted cylinder positioned for movement into a variety of operative positions between an impeller 14 and diffuser vane passages 26. The Davis invention does not provide for, as the invention being described hereinafter, a pump having infinitely variable single or independently modulatable multiple pump outputs capable of handling a fluid containing solid contaminant particles.

A typical fluid delivering system of the prior art as noted earlier which includes a shuttered diffuser, a centrifugal pump operating at a fixed speed ratio to the engine, a metering valve for distributing fluid delivered by the pump and a control system for positioning the shutter in response to the operation of the metering valve is set forth in U.S. Pat. No. 3,826,586 to Richards. The specification of Richards indicates that the combination just recited is a typical environment where a shutter diffuser valve of the type shown by Davis would find utility. The Richards patent fairly represents the prior art and represents to the extent shown a technological benchmark from which the invention to be described hereinafter provides a fresh and new departure in providing a pump that has single or multiple outputs which are independently infinitely variable. The pump containing the invention is also capable of effectively dealing with contaminant particles carried by the fluid.

A patent worthy of inclusion in the background art from which the subject invention advances the state of the art is found in the U.S. Pat. to S. O. Johnson, No. 2,991,982 and E. L. Small, No. 114,211. Both of these patents deal with fluid handling systems and illustrate simultaneous uniform movement of a number of elements to control fluid flow. The Johnson patent is directed to a centrifugal fluid moving device while the Small patent is directed to an improvement in a water wheel. Neither of these patents consider the problem of contaminant particles in the fluid becoming lodged in the moveable elements, nor do these patents provide for contaminant particle handling as will become evident in the description that follows in respect of the invention hereinafter described.

DISCLOSURE OF INVENTION

This invention relates to a centrifugal pump capable of handling a fluid containing solid contaminant particles. The pump is of the type that includes an impeller to propel the fluid through a radial outlet to a diffuser which includes a plurality of diffuser passages. The improvement is comprised of the following cooperative combination which includes rotatably mounted valve elements passing, in part, through the diffuser and across the diffuser passages. Each of the valve elements have a port therethrough to variably selectively allow fluid passage therethrough upon rotation of the valve element.

A driving arrangement is coupled to each of the valve elements to thereby affect a yieldable rotation of the valve elements in one direction to progressively reduce the opening of the valve element port to the diffuser passage. The aforementioned driving arrangement is also drivingly coupled to the valve elements to provide a direct mechanical coupling to the valve element to thereby affect a nonyieldable rotation of the valve element in an opposite direction to increase the opening of the valve port to the diffuser passage, to thereby ensure that contaminant particles that lodge between a portion of said valve port and the diffuser passage and interrupt movement of one or more valve element port closings do not prevent the remaining valve port elements from closing. During the opposite rotation of the valve elements there is a direct mechanical drive that ensures the opening of the valve port to thereby release the contaminant particle and allow passage of the particle from the valve element and the diffuser.

It is therefore a primary object of this invention to provide a centrifugal pump having an infinitely variable diffuser output which pump includes flow control diffuser valve elements that are operated through a drive apparatus that provides a yieldable or soft closing and a non-yieldable or hard opening of the diffuser valve elements.

Another object of the invention is to provide a centrifugal pump that is capable of handling a fluid containing solid contaminant particles, which particles should they lodge and jam in a working diffuser valve will only interrupt flow control at the location in the pump that the jam occurs.

Yet another object of this invention is to provide a pump that has multiple, independent, modulatable outputs.

A further object of this invention is to provide a diffuser valve drive apparatus or mechanism for the valve elements in a pump diffuser, which drive affects independent yieldable movement of the valve in a valve closing direction such that should a contaminant particle in a fluid being handled by the pump become jammed in a diffuser pipe and interrupt the movement of the jammed valve the remaining diffuser valve movements will continue to affect a closing of the unjammed valves. The diffuser valve drive when functioning in a valve opening mode establishes a direct mechanical drive to the valve to ensure the opening of the valve to thereby release the jammed contaminant particle and allow passage of the particle from the valve and the diffuser.

In the attainment of the foregoing objects, the invention contemplates the provision of a centrifugal pump having single or multiple modulated diffuser outputs, which pump is capable of handling a fluid containing solid contaminant particles. The pump is of the type that includes an impeller to propel the fluid through a radial outlet to a diffuser which includes a plurality of diffuser passages. The centrifugal pump includes in combination rotatably mounted valve elements which pass in part through the diffuser and across the diffuser passages. Each valve element has a port therethrough positioned in relationship to the passage such that rotary movement of the valve element variably allows fluid passage therethrough.

A driving mechanism or apparatus is drivingly coupled to each of the valves. Each valve element has a flange secured thereto for rotation therewith. Each of the flanges have first and second members mounted thereon and extending therefrom. The first member extends along the axis of rotation of the valve element while the second member extends from the flange along a path parallel to the axis of rotation of the valve.

An intermediate drive component is rotatably mounted on the first member and includes a resilient device mutually coupled to the intermediate drive component and the second member.

An input drive means is mechanically coupled to the intermediate drive component to thereby induce a yieldable rotation of the valve in one direction. The input drive means is co-operatively mechanically coupled to the second member to establish a nonyieldable rotation of the valve element in an opposite direction. The structure recited next above thereby ensures that contaminant particles that lodge between a portion of the valve element port and the diffuser passage and interrupt movement of one or more valve element port closings do not prevent the remaining valve port elements from closing, while during opposite rotation of the valve elements, there is a direct mechanical drive that ensures the opening of the valve port to thereby release the contaminant particle and allow passage of the particle from the valve element port and the diffuser.

In the preferred embodiment of the invention the pump has but a single modulated diffuser output and the intermediate drive component is configured to have gear teeth at a perpetual portion thereof and the input drive is a gear which drivingly engages the gear teeth of the intermediate drive component. A variation of the intermediate drive component has a portion thereof that projects at an angle from the first element and the input drive means is in the form of a projection extending towards the flange and carried by a rotatable input member. The projection of the input drive engages either the intermediate drive component or the second member depending upon the direction of rotation of the input member. A resilient device in the form of a spring is mutually coupled to the intermediate drive component and the second member.

Another embodiment of the invention is present in a multiple fluid flow centrifugal pump which is capable of providing outputs that are independently infinitely variable. The pump impeller and diffuser, as well as rotatably mounted valve elements, are the same as that of the preferred embodiment. There are, however, provided a plurality of independently operable driving means each coupled respectively to different valve elements to thereby independently affect a yieldable rotation of the valve elements in one direction to progressively reduce the opening of the valve element ports to the diffuser passage. Each of the independently operable driving means are drivingly coupled to different valve elements which provides a direct mechanical coupling to the valve elements to thereby effect a nonyieldable rotation of the valve elements in an opposite direction to thereby provide the independent infinitely variable multiple outputs.

Other objects and advantages of the present invention will be apparent upon reference to the accompanying description when taken in conjunction with the following drawings:

BEST MODE FOR CARRYING OUT THE INVENTION

Figure 1:
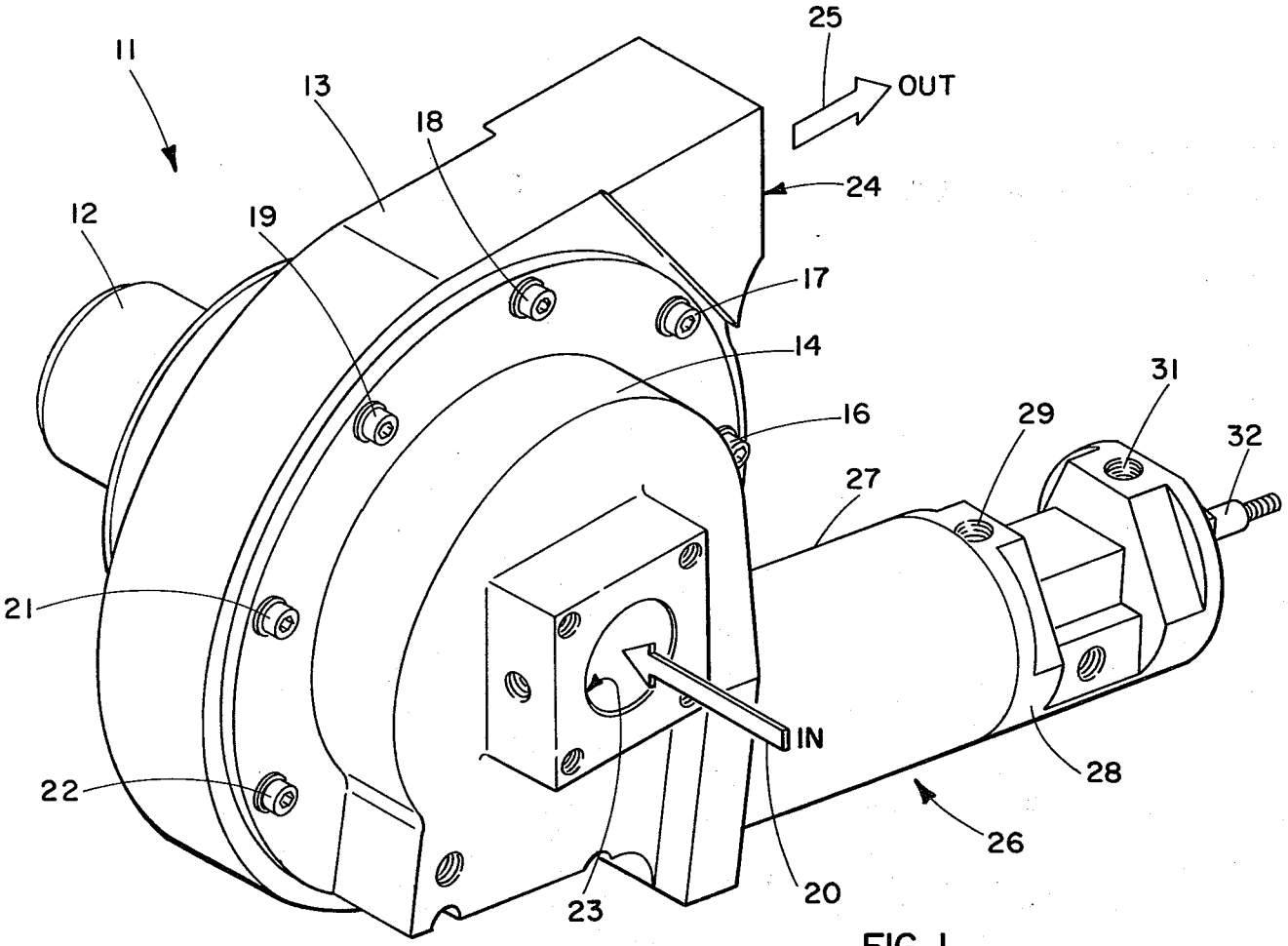
FIG. 1 is a three dimensional illustration of a centrifugal pump emboding the invention.

Reference is now made to FIG. 1 which illustrates in three dimensional form a centrifugal pump 11 that embodies the invention. In this figure it can be seen that the pump is made up of a drive unit (not shown) located in housing 12 and a collector housing 13 disposed between a modulator cover 14 and the drive unit housing 12. The modulator cover 14 is secured to the collector housing 13 by fasteners 16, 17, 18, 19, 21 and 22. The centrifugal pump 11 has a fluid inlet 23 and a collector output 24. The inlet 23 of the modulator cover 14 has secured thereto a conduit not shown to deliver fluid from a tank not shown. An actuator assembly 26 includes an actuator guide housing 27. A servo cylinder unit 28 is shown secured to the actuator guide housing 27. The servo cylinder unit 28 is provided with servo ports 29 and 31. Through servo ports 29 and 31, fluid is delivered to and from a cylinder not shown but contained within the servo cylinder unit 28. An actuator rod 32 is shown entering the servo cylinder unit 28 to its right.

Figure 2:
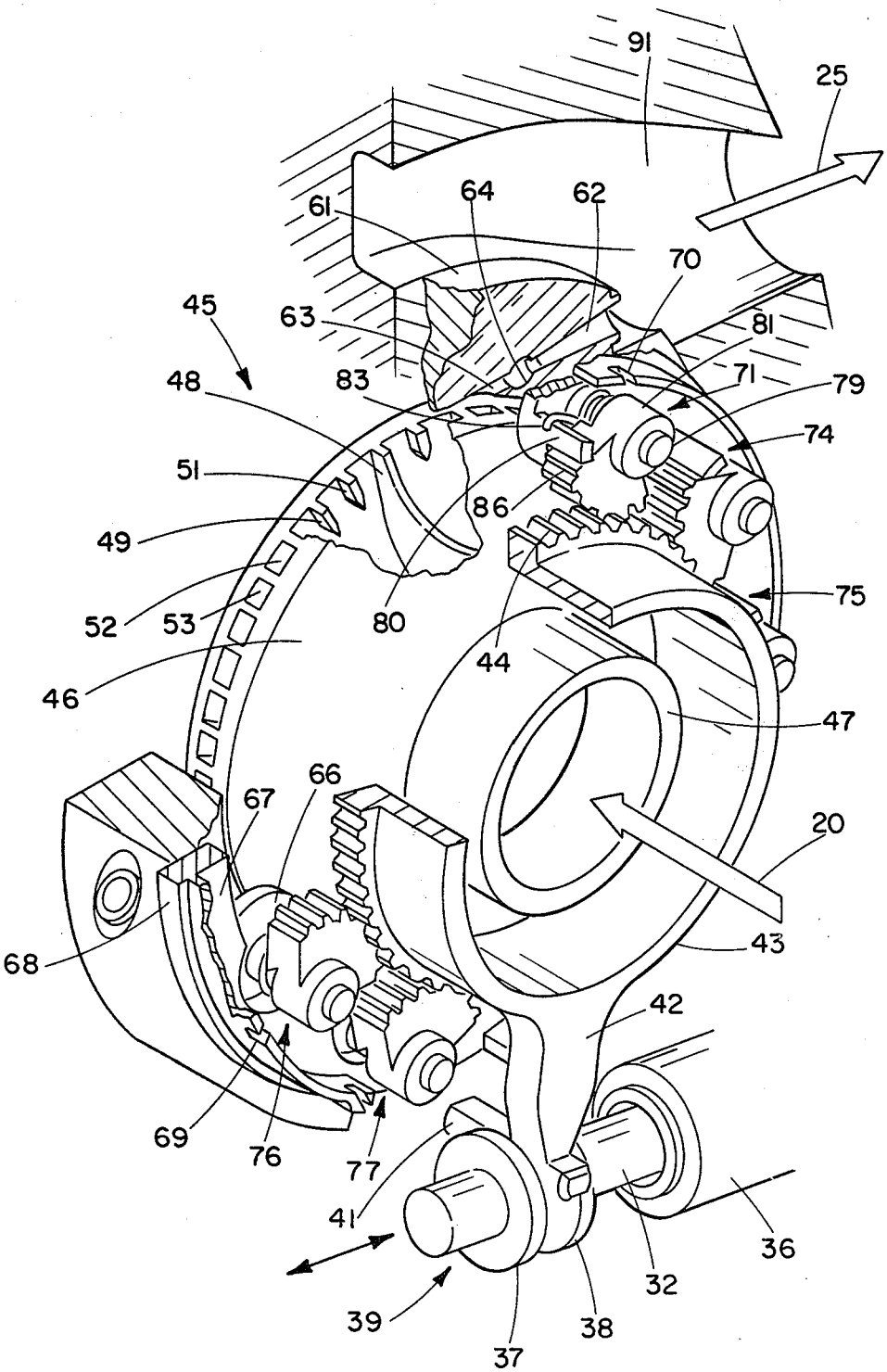
FIG. 2 is a partial section of the centrifugal pump of FIG. 1 sectioned in a manner to expose the details of the invention.
Figure 3:
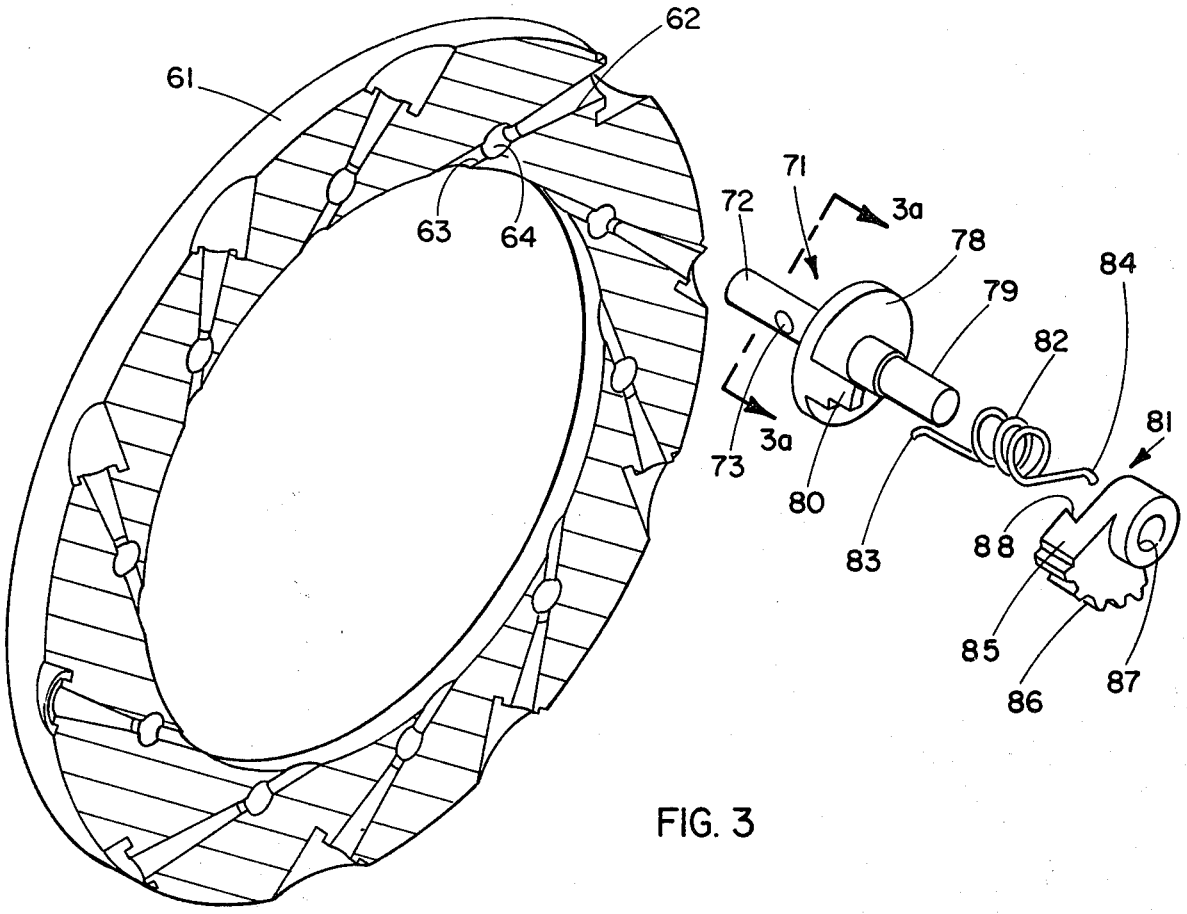
FIG. 3 depicts a diffuser in section with a single valve element and intermediate drive shown in an exploded manner to the right of the diffuser.

Reference is now made to FIG. 2 which is a partial section of the centrifugal pump of FIG. 1, sectioned in a manner to expose the details of the invention. The description of FIG. 2 should be taken in conjunction with the illustration of FIG. 3. In FIG. 2 the modulator cover 14 is shown completely removed to expose in section the details of the invention. In order that there be a point of reference with respect of FIG. 1, attention is directed to the fluid inlet arrow 20 and collector output arrow 25 shown in FIG. 1 and FIG. 2. The actuator rod 32 is also shown to be revealed by the removal of the modulator cover 14. A bearing support 36 which forms an integral part of the actuator guide housing 27 of FIG. 1 is partially shown in FIG. 2. The actuator rod 32 has disposed thereon and integrally secured thereto a pair of discs 37, 38, which form an actuator pin drive 39. An actuator pin 41 is shown disposed between discs 37 and 38. The actuator pin 41 has integrally formed therewith an arm 42 which arm 42 terminates at its upper end as shown with a coupling cylinder 43. Integrally formed with the coupling cylinder 43 is a ring gear 44. An impeller shroud 46 has integral therewith a cylindrical member 47. Fluid enters the pump through the cylindrical member 47 as shown by arrow 20. The impeller 45 includes impeller vanes such as impeller vane 48. Impeller vane segments 49 and 51 establish impeller discharge ports of the nature shown at 52 and 53. The drive unit included in housing 12 of FIG. 1 and its connection to the impeller 45 is not shown in this partial section which should be understood as being present to provide the rotary input to the impeller 45 to draw fluid into the cylindrical member 47 as shown by the arrow 20. The impeller 45 propels fluid through the radially disposed impeller discharge ports or outlets 52 and 53. The operation of the impeller 45 is conventional. Surrounding the impeller 45 is a diffuser 61. The total character of the diffuser 61 can best be appreciated by a study of FIG. 3. FIG. 3 depicts a diffuser 61 in section with a single valve element 71, as well as an intermediate drive member 81 shown in exploded fashion to the right of the diffuser 61. The diffuser 61 of FIG. 3 is of the pipe diffuser type. Each pipe is fashioned of a cone shaped volute 62 and a throat 63. Between the throat 63 and the cone shaped volute 62 there is shown an opening 64, which opening 64 passes through the passageway formed by the throat 63 and the cone shaped volute 62. It is recognized that pipe diffusers absent the openings 64 have existed in the art before. Continuing with FIG. 3, the valve element 71 is shown to include a cylindrical element 72 which cylindrical element 72 is designed to snuggly fit for rotation in opening 64 of the diffuser 61. The cylindrical element 72 includes a port 73 which passes through the cylindrical element 72. When the valve element 71 is assembled with the diffuser 61 such that the cylindrical element 72 passing through the opening 64, the port 73 can be alligned with the passageway formed by the throat 63 and the cone shaped volute 62. It is believed apparent that rotation of the valve element 71 would variably expose the port 73 to the passageway formed by the throat 63 and the cone shaped volute 62, such that if the center line of the port 73 were coincident with the center line of the throat 63 and the cone shaped volute 62, fluid would pass through the port 73 unimpedded in its movement.

It should be understood that FIG. 2 only shows five valve elements generally referenced by arrows 71, 74, 75, 76 and 77. The remaining valve elements have been removed in the illustration of FIG. 2 in order to expose for visual inspection the details of the centrifugal pump.

Figure 3A:
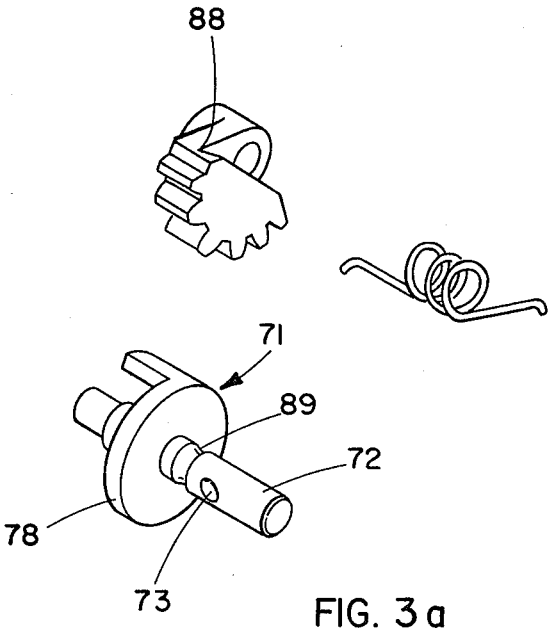
FIG. 3*a* is a view of the valve element and intermediate drive viewed from the rear along the line 3*a*—3*a*.

The structure of the valve elements 71, 74, 75, 76 and 77 can best be understood by reference to FIG. 3 where valve element 71 is shown in detail. The valve element 71 further includes a flange 78, formed integrally with the cylindrical element 72. The flange 78 has extending therefrom a first member 79. The first member 79 is circular in cross section and includes a reduced end portion, as shown, that allows the intermediate drive component 81 to be secured thereover for rotation with first member 79 passing through the opening 87. The flange 78 also includes a second member 80 or throttle opening arm as it may be termed, positioned as shown on the flange 78. The second member 80 extends in a path parallel to the axis of rotation of the valve element 71. A spring 82 of the configuration shown includes a spring end 83, that when assembled, rests in the fashion shown in FIG. 2 on second member 80. Spring end 84 when assembled rests in the cut back spring retaining groove 88. The cut back spring retaining groove 88 can be seen better in FIG. 3*a* FIG. 3*a* is intended to represent a view taken along the line 3*a*—3*a*. When FIG. 3*a* is studied it can be seen that the cylindrical throttle element 72 includes a necked down or reduced diameter portion 89. The reduced diameter portion 89 will allow the cylindrical throttle element 72 to shear from and be free of the remainder of the valve element 71 should cylindrical throttle element 72 become unmoveably jammed in a manner to be described hereinafter.

Referring again to FIG. 2, it will be observed that flange 66 of valve element 76 is held in place by a scalloped or arcuate shaped plate portion 67 of a retaining ring 68 of the configuration shown. The retaining ring 68 may also be provided with slotted notches 69, 70 that may be engaged by a spring end, such as spring end 84 of FIG. 3. Further comment will be made hereinafter about the utility of the notches 69, 70. The intermediate drive component 81 and its peripheral disposed segmented gear teeth 86 engage ring gear 44 as shown. Whenever the ring gear 44 is moved in a clockwise direction, the intermediate drive member 81 is caused to rotate in a counterclockwise direction, which in turn causes spring 82 through movement of spring end 84 to be wound in a tightening direction, which results in spring end 83 forcing second member 80 to resiliently follow the intermediate drive component 81. The port 73 during this just described movement is moved from a valve opening position to a valve closed position. By this it is meant that the cylindrical throttle element 72 is turned in such a manner that the diffuser passageway between the throat 63 and the cone shaped volute 62 is closed. Movement of the ring gear in a counterclockwise rotation causes the intermediate drive component to be rotated in a clockwise direction which brings the intermediate drive component 81 and its surface 85 in contact with the second member 80. It will be appreciated that there is now a direct mechanical drive from ring gear 44, peripheral segmented gear portion 86, surface 85, second member 80, and flange 78 which therefore turns cylindrical throttle element 72. This just described drive connection provides for a mechanical opening or hard opening of the valve as it has been termed hereinbefore.

From the foregoing description, it should be apparent that in the event that a contaminant particle not shown but contained in the fluid delivered from the impeller 45 to a diffuser throat 63 becomes lodged between the port opening 73 and the passageway defined by the throat 63 and cone shaped volute 62, there would result a jamming of the movement of the cylindrical throttle element 72. The spring connection described earlier would allow interruption of the movement of but a single diffuser valve absent any contaminant particle jamming the remaining valve elements. These remaining valves would be resiliently driven into a closed position. Upon receiving an open command, as evidenced by movement of the actuator 32 to cause the ring gear 84 to move in a clockwise direction, all valve elements would receive simultaneously a direct mechanical or hard valve opening movement. This hard opening of the valves would allow a jammed contaminant particle to be freed and continue its flow through the diffuser passage into the collector 91.

Figure 4:
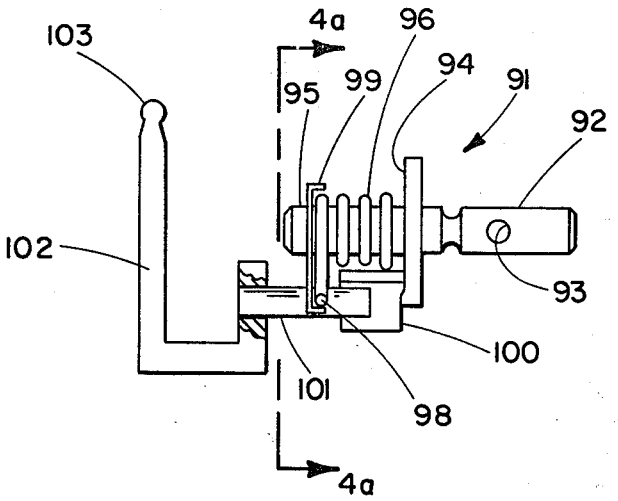
FIG. 4 is a side view of a variation of the driving arrangement for the diffuser valve element.
Figure 4A:
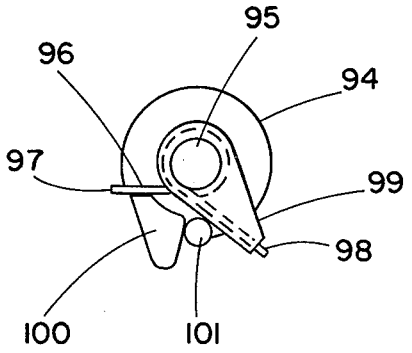
FIG. 4*a* is a view taken along the line 4*a*—4*a* in FIG. 4.

Reference is now made to FIG. 4 in which there is illustrated a variation of the intermediate drive arrangement for a valve element 91. Valve element 91 includes, as was earlier described, a cylindrical drive element 92 and a port 93. A flange 94 is integrally secured to the cylindrical throttle element 92, as well as to a first member 95. The flange member 94 has a second member 100 which projects in a path parallel to the axis of rotation of the valve element 91. A spring 96 is shown positioned around the second member 95 with one end 97 in a butting relationship with second member 100 as can be seen in FIG. 4*a*. The other end of 98 of spring 96 is shown resting on and in contact with intermediate drive projection 99. The intermediate drive projection 99 is rotatably mounted on second member 95. A bar or projection 101 is shown secured to arm 102, which arm 102 terminates with actuating pin 103. It is to be understood that FIG. 4 is a schematic representation of this alternative drive arrangement and that there would be required a plurality of projecting bars 101 in a butting relationship with the second members of each of the flanges. Studying FIG. 4*a*, it should be apparent that if the projecting bar 101 is moved to the right as viewed in FIG. 4*a*, the intermediate drive projection 99 will cause the spring 96 to be wound in a tightening direction, which in turn will cause spring end 9B to move second member 100 in a counterclockwise direction. This just described movement would be termed a soft or resilient valve closing.

Should the projecting bar 101 be moved to the left, as viewed in FIG. 4*a*, there would be a direct mechanical abutting connection between the projecting bar 101 and the second member projection 100 to provide what has been termed hereinbefore as a hard opening.

Figures 5, 5A:
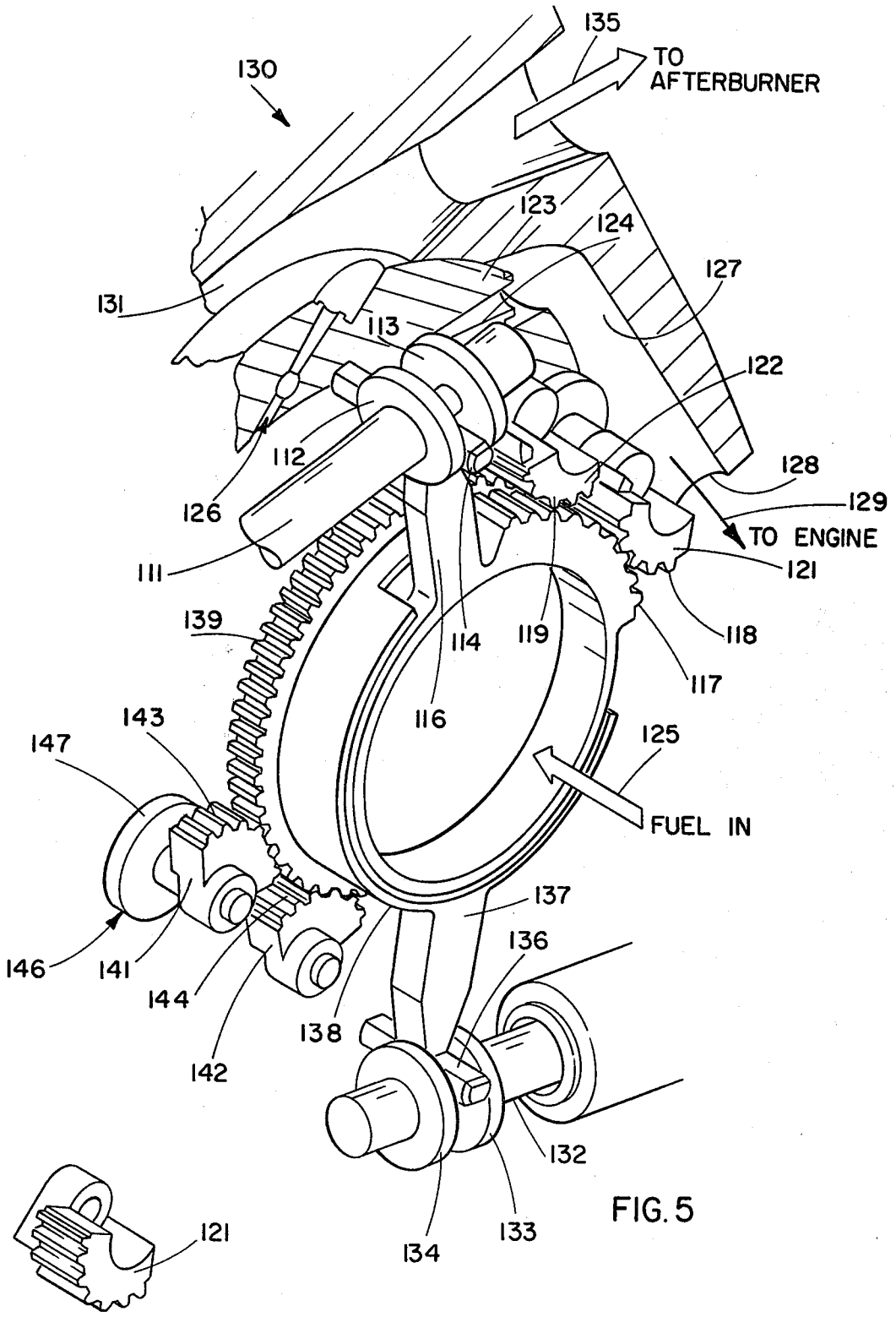
FIG. 5 is a partial section of a centrifugal pump of an embodiment of the invention where the pump has multiple fluid outputs.
FIG. 5*a* is a three dimensional illustration of an intermediate drive member employed in the invention embodiment of FIG. 5.

Reference is now made to FIG. 5 which shows in partial section a centrifugal pump embodying the invention in which the pump has multiple fluid outputs. In order to ease the understanding of the operation, many components basic to the pump are not shown, such as the impeller, which of course is understood to be present, as well as a drive unit for the impeller. The impeller not shown is positioned in exactly the same fashion as shown in some detail in FIG. 2. As in earlier illustrations, only those details essential to explain the operation of this embodiment will be shown. At the top of FIG. 5 there is shown a collector 130 with one output delivered to the engine and another output to an afterburner. The invention to be described hereinafter would find utility where it was decided to have a single pump continuously control the amount of fuel to an engine, while simultaneously providing the capability of suddenly feeding a large quanity of fuel to the engines' after-burner. In order that there be a fuel control to the engine there is provided as shown, a main fuel actuator 111, which has integrally secured thereto a pair of discs 112 and 113 which cooperate with a main fuel actuator pin 114. The main fuel actuator pin 114 is integrally secured to a main fuel actuator arm 116, which in turn has, as is shown, a ring gear segment 117 integral therewith. The ring gear segment 117 has teeth which mesh with teeth 118 and 119 of intermediate drive members 121 and 122. The intermediate drive members 121 and 122, as well as the valve elements driven thereby, which valve elements are not shown in this figure, operate in the same fashion as the valve elements of FIG. 2. It is to be appreciated that movement of the main fuel actuator 111 will be translated into arcuate movement of the ring gear segment 117, which will in turn drive the intermediate drive units 121 and 122 in the fashion just described to provide a soft opening of the pipe diffuser 123 to allow fuel entering as shown by arrow 125 to pass through the impeller not shown, and out the cone shaped volute 124 into a main fuel collector 127. The fuel so collected is delivered to outlet 128 and thence is delivered to the engine as designated by the arrow 129.

An afterburner fuel actuator 132 has integral therewith a pair of discs 133 and 134 which cooperate with an afterburner fuel actuator pin 136. The afterburner fuel actuator pin 136, has integrally formed therewith an afterburner fuel actuator arm 137. The arm 137 is integrally secured to a coupling cylinder 138 as shown. The coupling cylinder 138 has a ring gear 139 fashioned at one end thereof. The ring gear 139 cooperates with teeth 133 and 134 of the intermediate drive members 141 and 142. A valve element 146 is partially shown and includes a flange 147. The valve element 146 is of the same construction as the valve element 71 of FIG. 3. It is to be understood that only two of the intermediate drive members 141 and 142 are shown in this figure, but there of course would be included intermediate drive members and valve elements cooperating with an equal number of diffuser passages. Just such a diffuser passage 126 is shown terminating at additional collector 131, which additional collector 131 delivers fuel as shown by the arrow 135 to the afterburner.

In the operation of this embodiment of the invention, the main fuel actuator 111 through its valve elements not shown provides a modulated fuel pump diffuser outlet through main fuel collector 127. Main engine power is therefore controlled by movement of main fuel actuator 111, while afterburner power is controlled by movement of afterburner fuel actuator 132.

FIG. 5*a* is a three dimensional illustration of an intermediate drive member 121 which is only partially shown in the embodiment of the invention of FIG. 5.

Returning to FIG. 2 and the function of notches 69, 70 on the retaining ring 68, the presence of the notches 69, 70 will provide yet another manner in which the springs employed in the soft closing may be secured to provide resistance to winding movement of the spring.

Although this invention has been illustrated and described in connection with the particular embodiments illustrated, it will be apparent to those skilled in the art that various change may be made therein without departing from the spirit of the invention as set forth in the appended claims.

I claim:

1. A centrifugal pump capable of handling a fluid containing solid contaminant particles, said pump of the type including an impeller to propel said fluid through a radial outlet to a diffuser which includes a plurality of diffuser passages, the improvement comprising:

rotatably mounted valve elements passing in part through said diffuser and across said diffuser passages, each valve element having a port therethrough to variably selectively allow fluid passage therethrough upon rotation of said valve element, means drivingly coupled to each of said valve elements to thereby affect a yieldable rotation of said valve elements in one direction to progressively reduce the opening of said valve element port to said diffuser passage, said means drivingly coupled to said valve elements providing a direct mechanical coupling to said valve element to thereby affect a nonyieldable rotation of said valve element in an opposite direction to increase said opening of said valve port to said diffuser passage to thereby ensure that contaminant particles that lodge between a portion of said valve element port and said diffuser passage and interrupt movement of one or more valve element port closings do not prevent the remaining valve port elements from closing, while during the opposite rotation of said valve elements there is a direct mechanical drive that ensures said opening of said valve port to thereby release said contaminant particle and allow passage of said particle from said valve port element and said diffuser.

2. The centrifugal pump of claim 1 wherein said means drivingly coupled to each of said valves includes for each of said valves a flange secured to said valve element for rotation therewith, each of said flanges having first and second members mounted thereon and extending therefrom, said first member extending along an axis of rotation of said valve element while said second member extends from said flange along a path parallel to said axis of rotation, an intermediate drive means rotatably mounted on said first member and having a resilient means mutually coupled to said intermediate drive means and said second member, a drive means input mechanically coupled to said intermediate drive means to thereby induce said yieldable rotation of said valve in said one direction, said input drive means co-operatively mechanically coupled to said second member to establish said nonyieldable rotation of said opposite direction.

3. The centrifugal pump of claim 2 wherein said intermediate drive means has a peripheral portion thereof in the form of gear teeth and said input drive means is a gear which drivingly engages said gear teeth of said intermediate drive means.

4. The centrifugal pump of claim 3 wherein said resilient means is a spring having one end in contact with said second member and the opposite end mechanically coupled to said intermediate drive means.

5. The centrifugal pump of claim 2 wherein said intermediate drive means has a portion thereof that projects at an angle from said first element and said input drive means is in the form of a projection extending towards said flange and carried by a rotatable input member.

6. The centrifugal pump of claim 5 wherein said resilient means is a spring having one end in contact with said second member and the opposite end in contact with said intermediate drive means.

7. The centrifugal pump of claim 3 wherein said input drive means gear is a ring gear which has integral therewith an arm that physically cooperates with a reciprocating actuator whereby reciprocating motion of said actuator results in the opening and closing of said valve elements.

8. The centrifugal pump of claim 5 wherein said input drive means projection and rotatable member has integral therewith an arm that physically cooperates with a reciprocating actuator whereby reciprocating motion of said actuator results in the opening and closing of said valve elements.

9. The centrifugal pump of claim 1 wherein said diffuser is of the pipe diffuser type.

10. The centrifugal pump of claim 1 wherein each of said valve elements includes a necked down portion to thereby allow said valve element to shear at said necked down portion should a contaminant particle jam the valve element so that it is immovable during said mechanical opening of said valve element port.

11. A multiple fluid flow centrifugal pump capable of providing multiple independent infinitely variable outputs, said pump of the type including an impeller to propel said fluid through a radial outlet to a diffuser which includes a plurality of diffuser passages, said multiple fluid flow centrifugal pump including in combination, rotatably mounted valve elements passing through said diffuser and across said diffuser passages, each valve element having a port therethrough to variably selectively allow fluid passage therethrough, a plurality of independently operable driving means each coupled respectively to different valve elements to thereby independently affect a yieldable rotation of said valve elements in one direction to progressively reduce the opening of said valve element port to said diffuser passage, each of said independently operable driving means drivingly coupled to said valve elements providing a direct mechanical coupling to said valve element to thereby affect a nonyieldable rotation of said valve element in an opposite direction to increase said valve opening to said diffuser passage to thereby provide said multiple independent infinitely variable outputs.

* * * * *